United States Patent [19]

Allen et al.

[11] Patent Number: 4,716,691

[45] Date of Patent: Jan. 5, 1988

[54] STADIUM BUILDING

[76] Inventors: Christopher M. Allen, 18 Birchview Road, Ottawa, Ontario, Canada, K2G 3G4; Roderick G. Robbie, 16 Cornish Road, Toronto, Ontario, Canada, M4T 2E2

[21] Appl. No.: 17,601

[22] Filed: Feb. 24, 1987

Related U.S. Application Data

[63] Continuation-in-part of Ser. No. 857,971, May 1, 1986, Pat. No. 4,676,033.

[51] Int. Cl.[4] ..... E04H 3/10; E06B 3/32; E04B 1/32; E04B 7/16

[52] U.S. Cl. ..... 52/6; 49/40; 52/64; 52/65; 52/80

[58] Field of Search ..... 52/6, 64–72, 52/80; 49/40, 41

[56] References Cited

U.S. PATENT DOCUMENTS

| | | | |
|---|---|---|---|
| 1,908,659 | 5/1933 | Cross | 52/64 X |
| 2,996,844 | 8/1961 | Paulson | 52/65 |
| 3,213,571 | 10/1965 | Olson | 49/40 X |
| 3,370,380 | 2/1968 | Petros | 52/64 X |
| 4,174,594 | 11/1979 | Panzini | 52/66 X |
| 4,381,629 | 5/1983 | Ahn | 52/66 |
| 4,555,865 | 12/1985 | di Monteforte | 52/67 |

FOREIGN PATENT DOCUMENTS

| | | | |
|---|---|---|---|
| 1684162 | 10/1969 | Fed. Rep. of Germany | 52/64 |
| 8006712 | 7/1982 | Netherlands | 52/6 |

OTHER PUBLICATIONS

"Amphitheater Umbrella", Architectural Forum, Nov., 1949, pp. 72 and 73.

"Retractable Dome", Architectural Record, May, 1959, pp. 250 and 251.

*Primary Examiner*—J. Karl Bell

[57] ABSTRACT

A retractable roof, for a stadium building, comprising a central arch separating a pair of ungular end segments, one end segment being movable into nesting relationship with the other end segment and the central arch being movable to rest above the nesting end segments, the nesting end segments and the above resting central arch being movable laterally whereby the interior of the stadium is more fully exposed.

10 Claims, 33 Drawing Figures

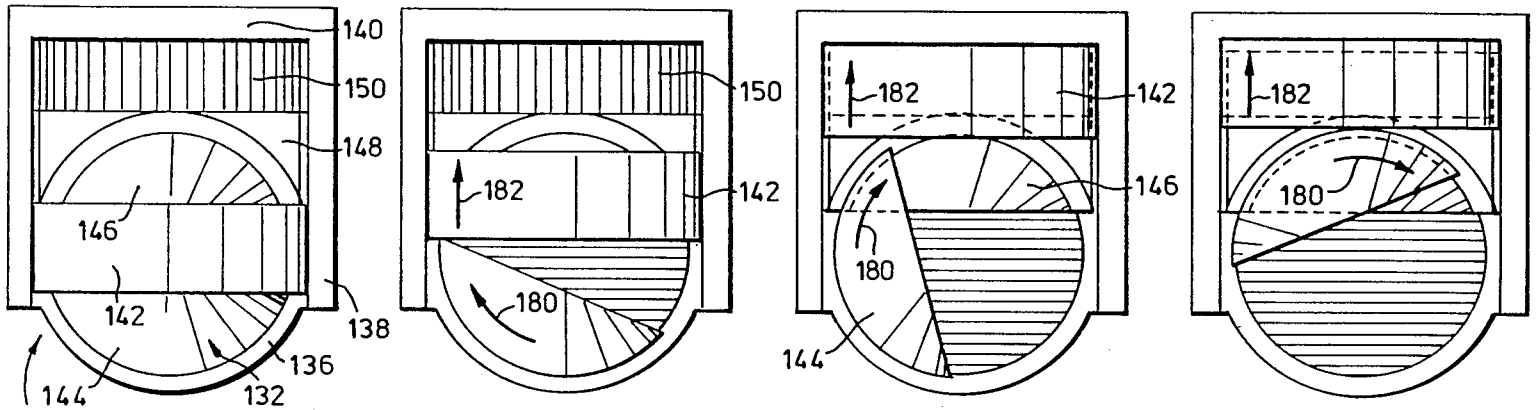
FIG. 25a
FIG. 25b
FIG. 25c
FIG. 25d
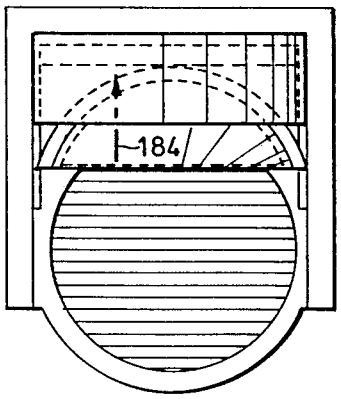
FIG. 25e
FIG. 25f
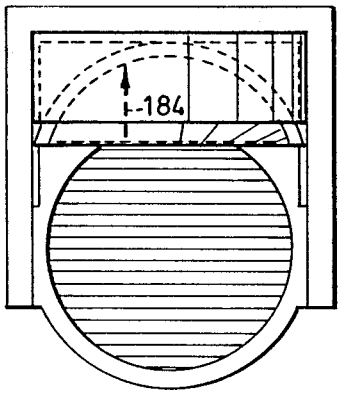
FIG. 25g
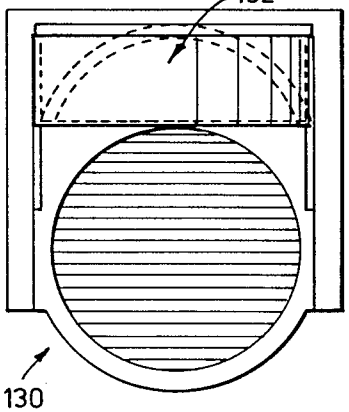
FIG. 25h

STADIUM BUILDING

This application is a continuation-in-part of U.S. patent application Ser. No. 857,971 filed May 1, 1986 now U.S. Pat. No. 4,676,033.

FIELD OF THE INVENTION

This invention relates to a stadium building having a retractable roof or dome.

BACKGROUND OF THE INVENTION

Covered stadiums are becoming more common because they provide a controlled environment for outdoor sports and extend the season for such activities. However, an indoor atmosphere is a drawback when the weather is fine because it detracts from the natural environment. To obtain the best of both worlds retractable roofs have been devised to expose the interior of the stadium. Such roofs have been found expensive to construct and/or incomplete in achieving their purpose of approximating complete exposure of the interior. In one type of structure a rectangular roof slides away as a unitary structure (Montreal, Canada) while in another type a round roof is opened in the manner of a camera lens shutter. The shutter roof leaves an overhanging arch while the unitary sliding roof requires an additional area of land equal to the area of land required for the stadium proper.

It is an object of the present invention to provide a stadium having a retractable roof of relatively simple construction giving maximum exposure of the interior.

SUMMARY OF THE INVENTION

Essentially the invention consists of a retractable roof, for a stadium building, comprising a central arch separating a pair of ungular end segments, one end segment being movable into nesting relationship with the other end segment, and the central arch being movable to rest above the nesting end segments, the nesting end segments and the above resting central arch being movable laterally whereby the interior of the stadium is more fully exposed.

BRIEF DESCRIPTION OF DRAWINGS

Example embodiments of the invention are shown in the accompanying drawings in which:

FIGS. 25*a–h* are a series of diagrammatic plan views of the stadium of FIG. 15 showing the stages of movement of the roof;

DESCRIPTION OF PREFERRED EMBODIMENTS

Figure 1:
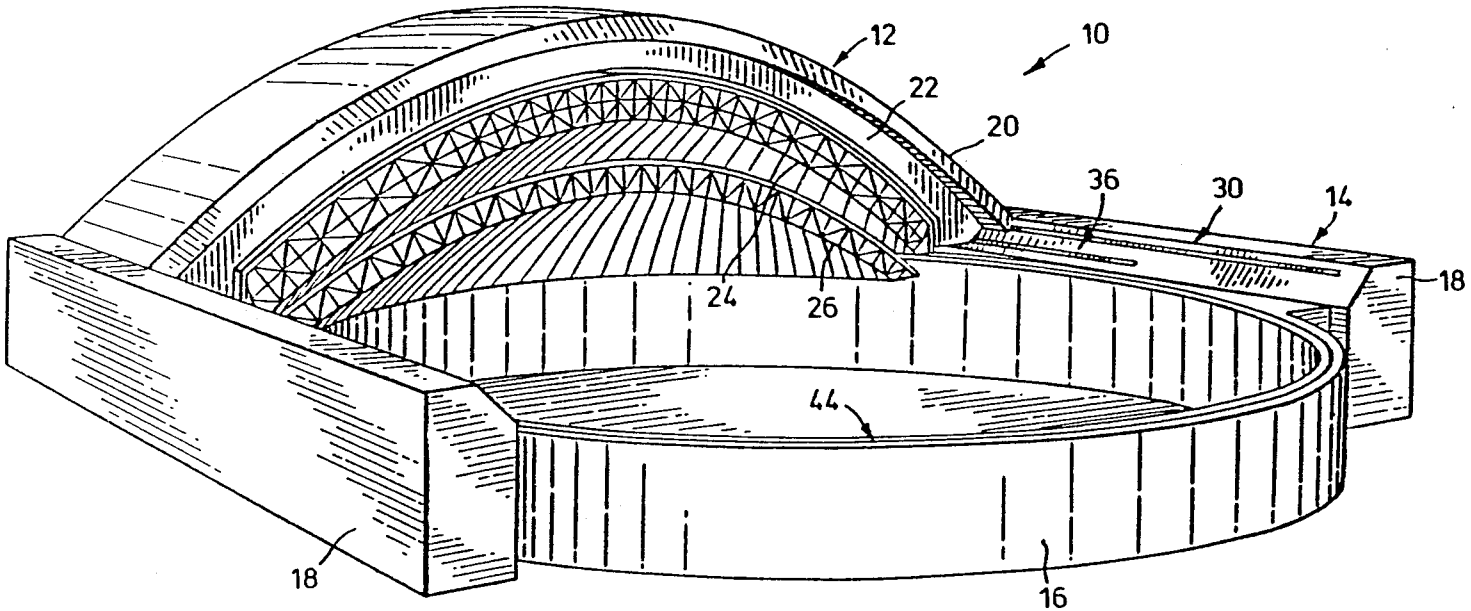
FIG. 1 is a perspective view of a stadium having a roof retracted into an open position.
Figure 2:
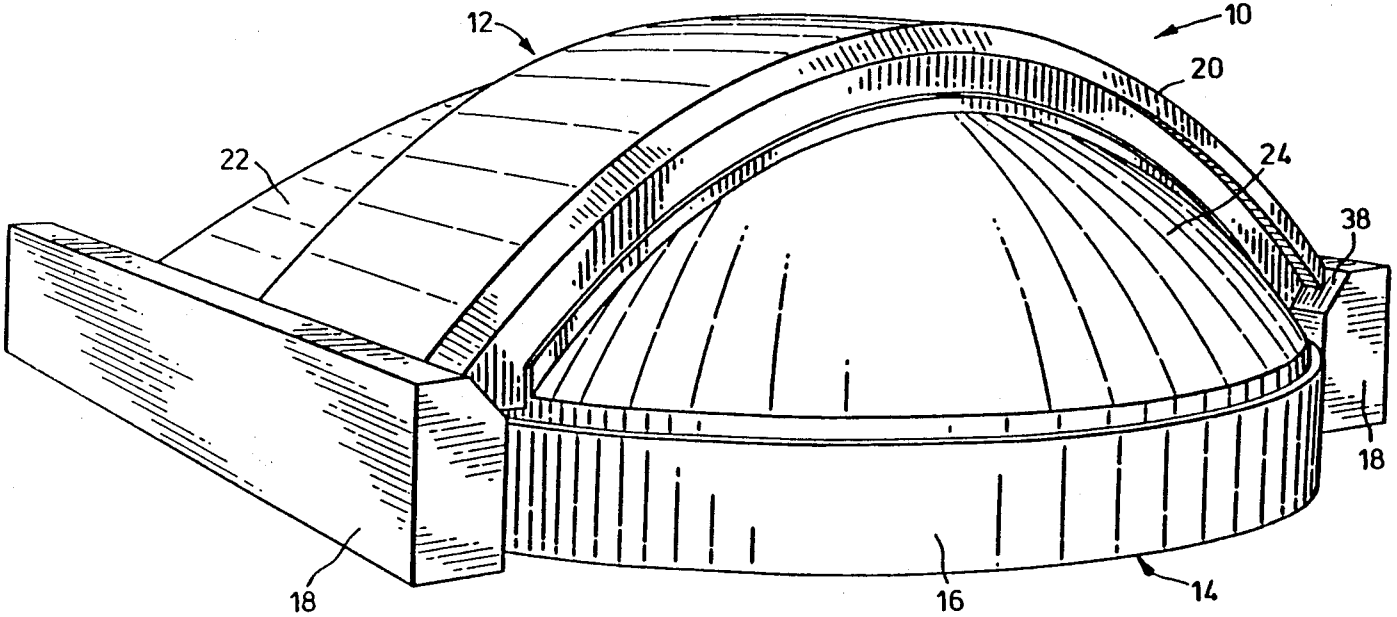
FIG. 2 is a view of the stadium of FIG. 1 showing the roof in a closed position.
Figure 3:
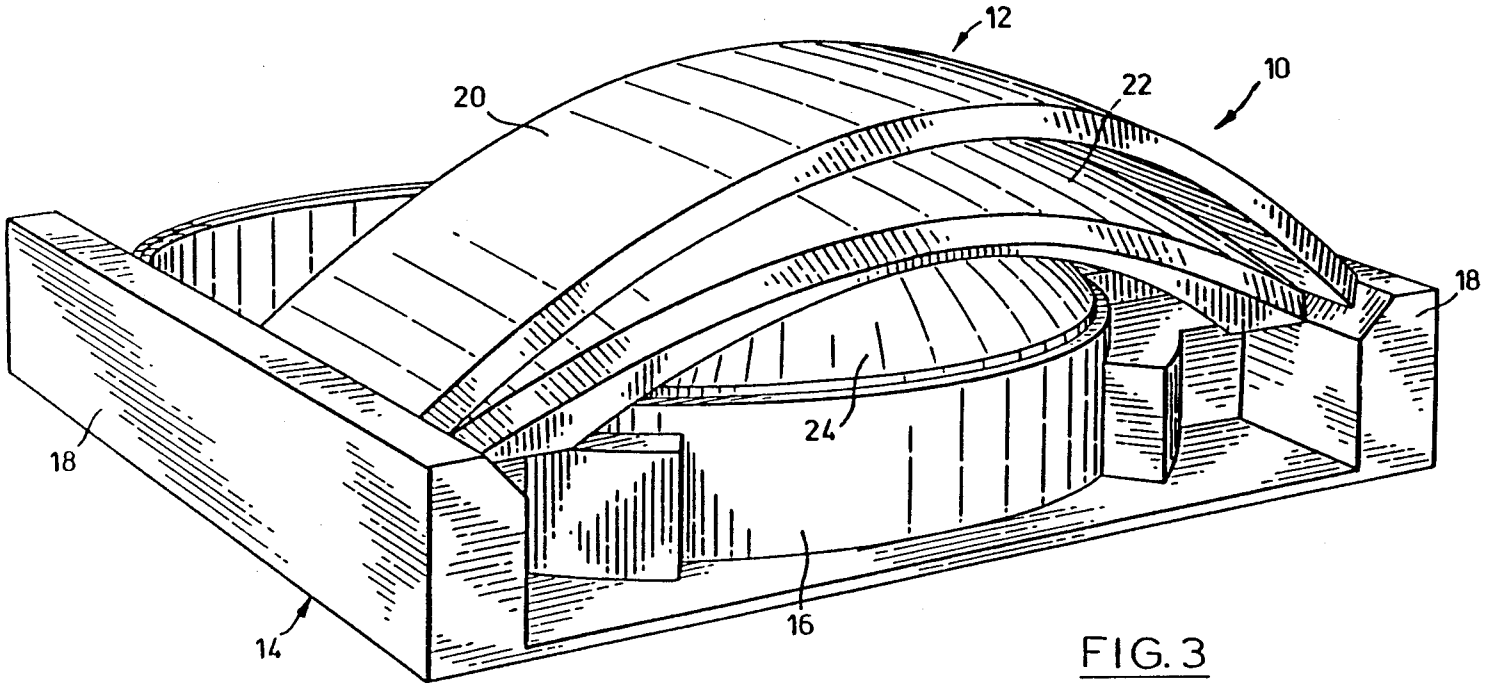
FIG. 3 is a perspective view of the stadium of FIG. 1 from the opposite end thereof.
Figure 4:
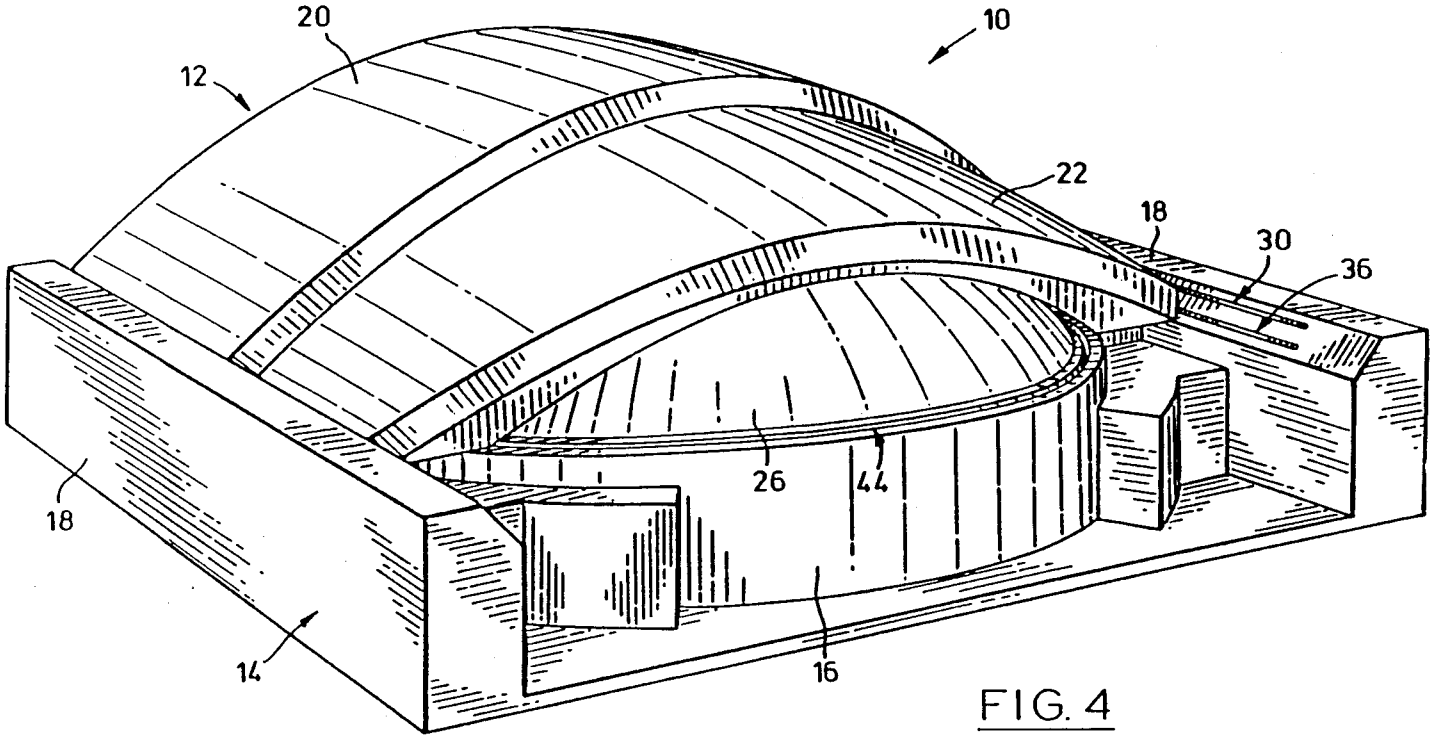
FIG. 4 is a perspective view of the stadium of FIG. 2 from the opposite end thereof.
Figure 5:
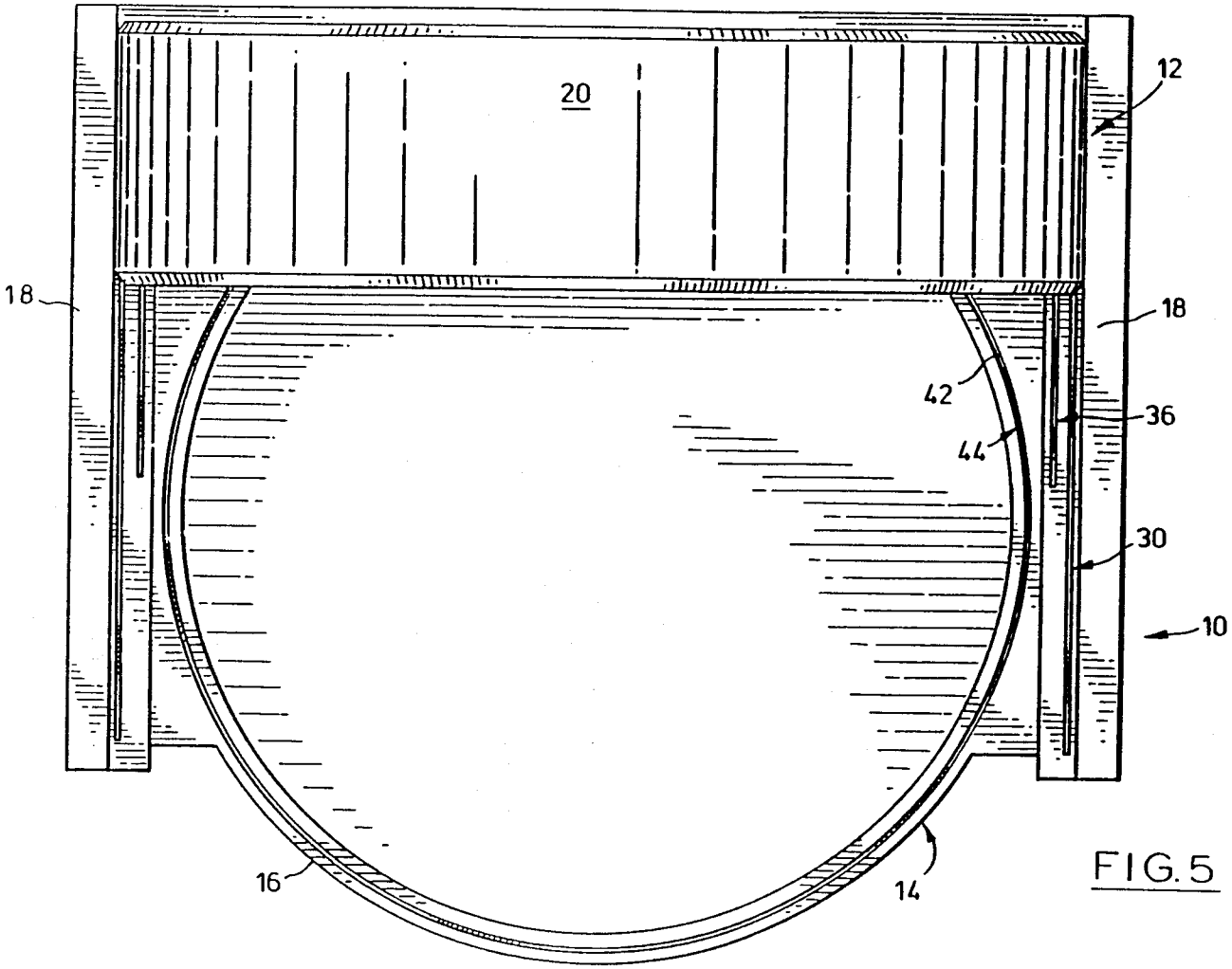
FIG. 5 is a plan view of the stadium of FIG. 1.
Figure 6:
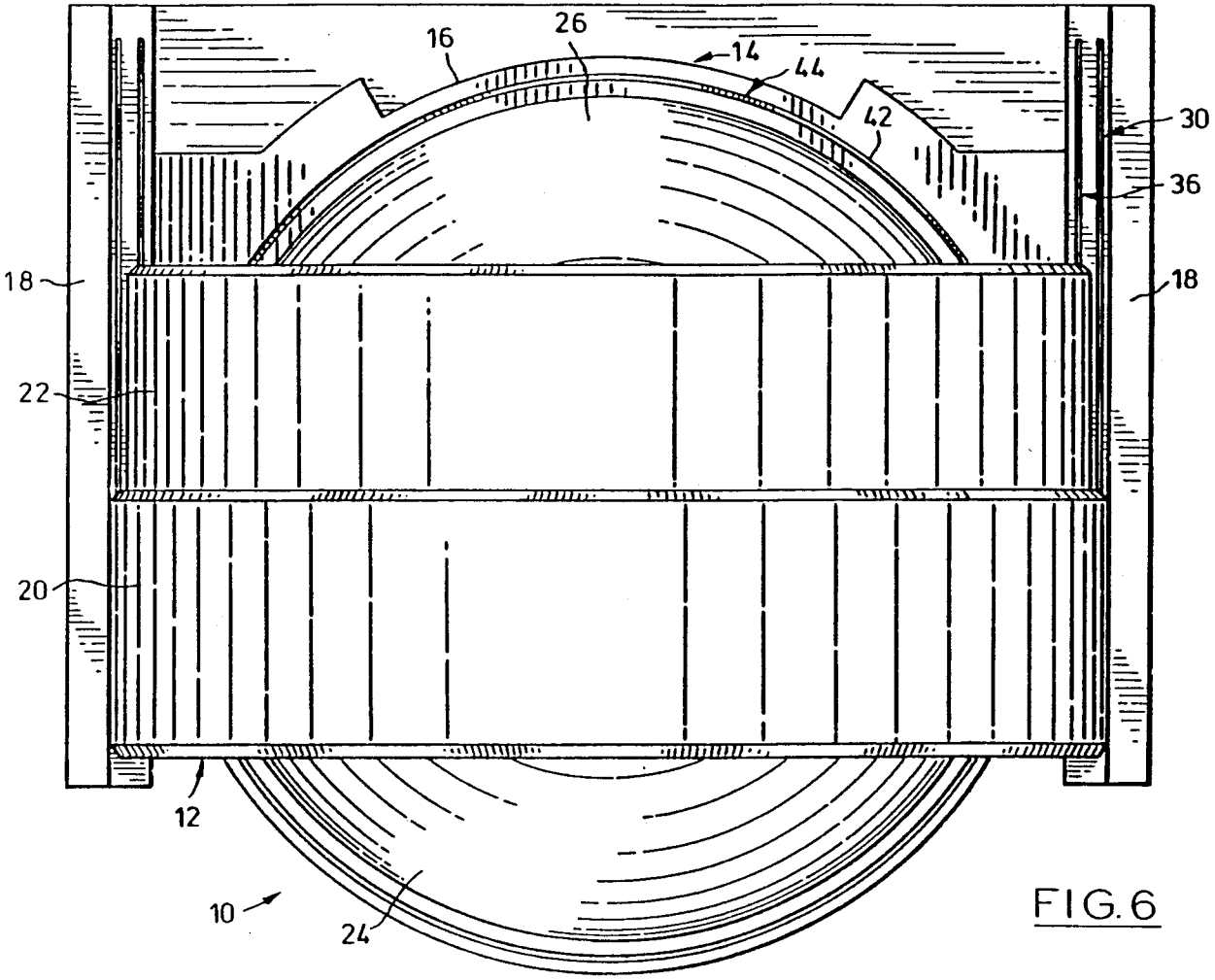
FIG. 6 is a plan view of the stadium of FIG. 2.

The example embodiment shown in FIGS. 1 to 14 of the drawings consists of a stadium building 10 having a dome 12 resting on a wall structure 14 comprising a circular wall 16 and a pair of parallel, opposed side walls 18 which are tangential to circular wall 16. Dome 12 consists of a central arch comprising a pair of parallel movable barrel vaults 20 and 22 movably mounted on side walls 18, and a pair of opposed ungular end segments 24 and 26 carried by circular wall 16. End segment 24 is movably mounted on a circular wall 16.

The manner of mounting movable barrel vaults 20, 22 and movable end segment 24 is shown in FIGS. 7 to 12 of the drawings. Each end of barrel vault 20 is carried on a row of trucks 28 which travel on a set of tracks 30 fixed on opposed parallel shoulders 32 on side walls 18. Each end of barrel vault 22 is carried on a row of trucks 34 which travel on a set of tracks 36 fixed on parallel shoulders 38 of side walls 18. End segment 24 is carried on a row of trucks 40 which travel on a set of tracks 42 in a recess 44 in circular wall 16. Each truck 28, 34 and 40 is joined by a pin connection 46 to a truss 47 its respective vault or segment.

Figure 10:
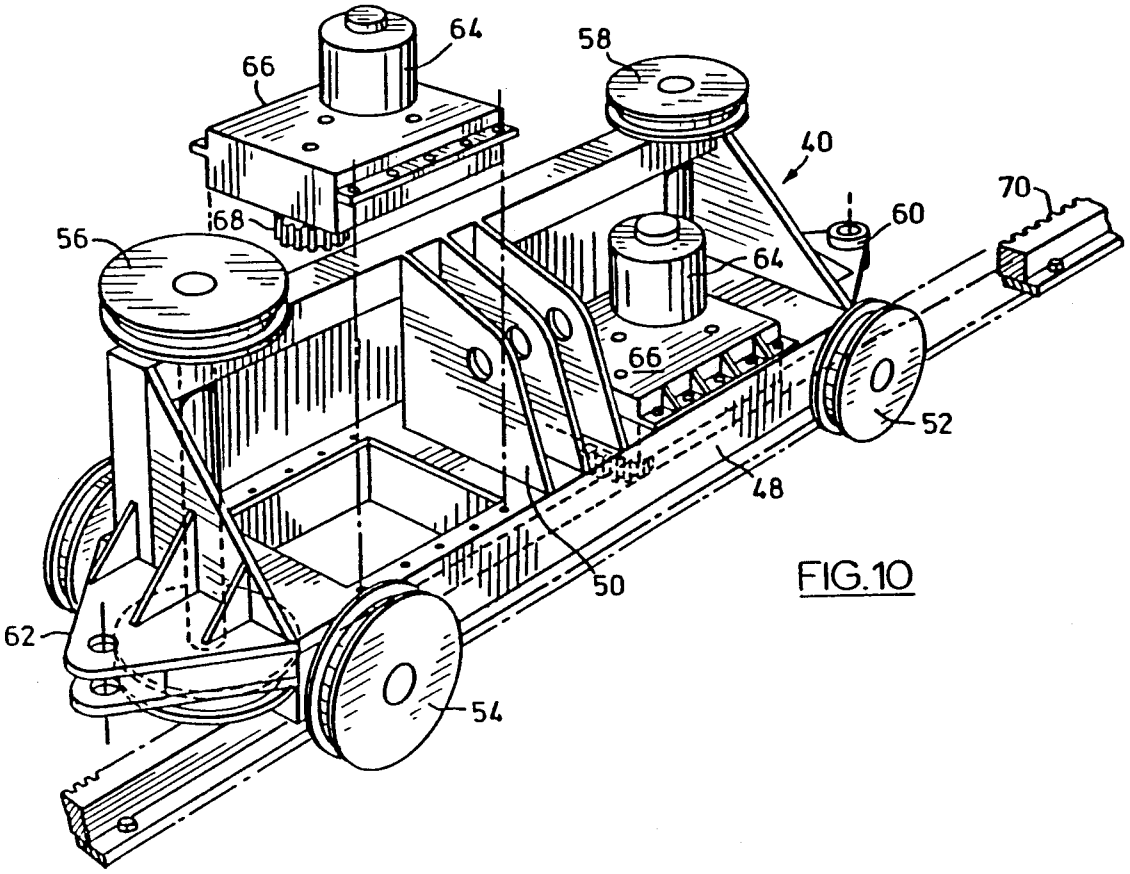
FIG. 10 is a perspective view of a truck of the movable end segment and arches.

Truck 40 is shown in detail in FIG. 10 of the drawings and consists of a carriage frame 48 having a set of fixed anchor plates 50 to which end segment 24 is pin connected. Two spaced pairs of double flanged wheels 52 and 54 are journally mounted in parallel on frame 48 and two further spaced pairs of double flanged wheels 56 and 58 are journally mounted in parallel on frame 48 normal to wheels 52 and 54. One end of frame 48 carries a coupling pin 60 and the other end carries an apertured coupling flange 62 for connecting a row of trucks 40 together. Certain of trucks 40 carry a pair of drive motors 64 each mounted on a gear box 66 which includes a pinion 68 engagable with a rack 70. Trucks 28 and 34 are of the same construction as truck 40 except that wheels 56 and 58 are removed as redundant.

Referring again to FIGS. 8, 9 and 12, each shoulder 32 of side walls 18 carries a pair of parallel, spaced supports 72 with inturned blocks 74. A first pair of rails 76 are fixed on shoulder 32 and a second pair of rails 78 are fixed on blocks 74, to form track 30. Rack 70 is fixed on shoulder 32 between rails 76. Rails 76 and 78 are engaged by pairs of wheels 52 and 54 on truck 28 and rack 70 is engaged by pinions 68. The same arrangement is associated with each shoulder 38 of side walls 18, i.e. supports 72, blocks 74, rails 76 and 78 (to form tracks 32), and rack 70. Recess 44 in circular walls 16 has a pair of secondary recesses 80 and 82 which have fixed pairs of opposed rails 84 and 86 respectively. Recess 44 also has further rails 88 and 90 normal one to the other. Rails 84, 86, 88 and 90 together form track 42.

Figure 11:
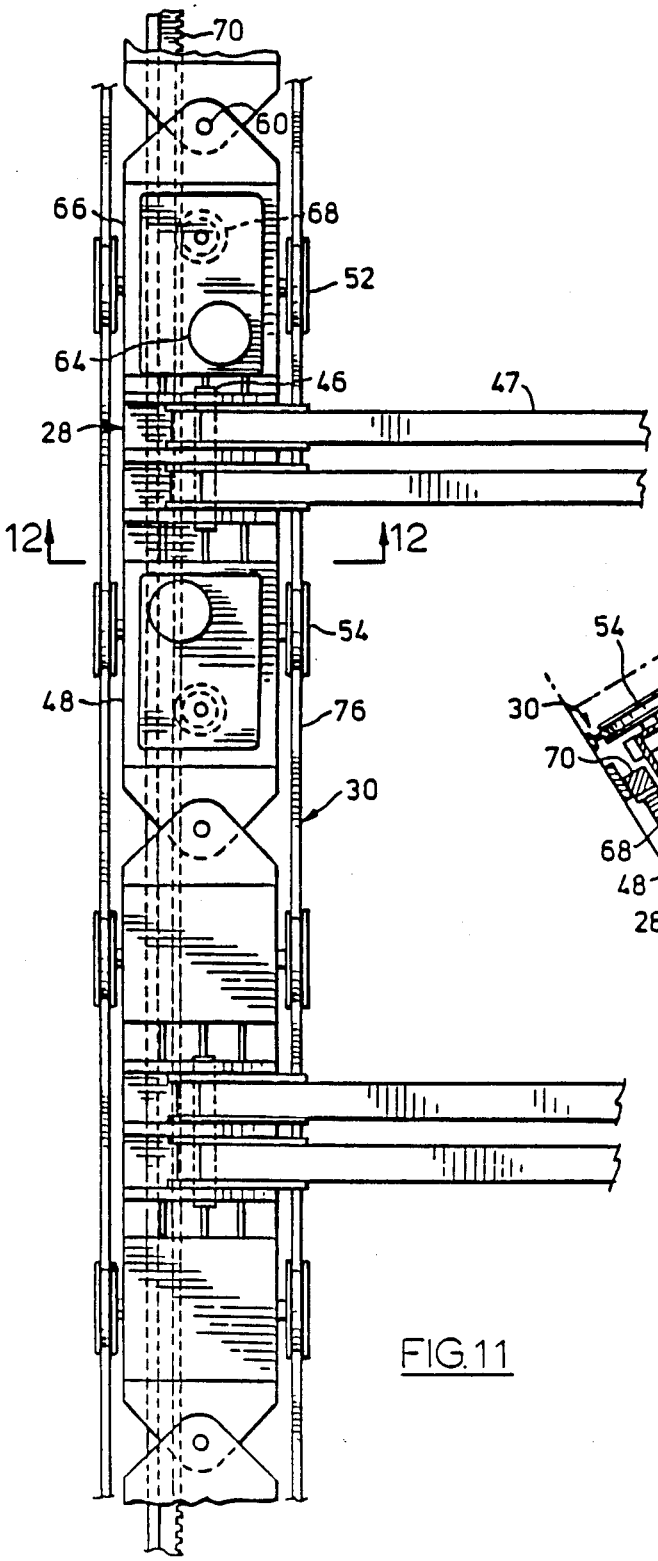
FIG. 11 is a detailed plan view of a plurality of the trucks of one arch.
Figure 12:
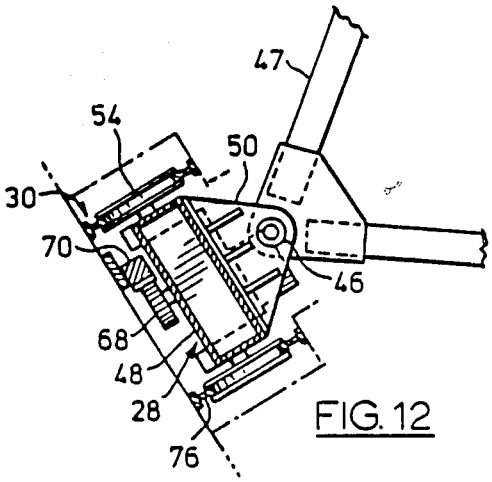
FIG. 12 is a cross-sectional view taken along line 12—12 of FIG. 11.
Figure 13:
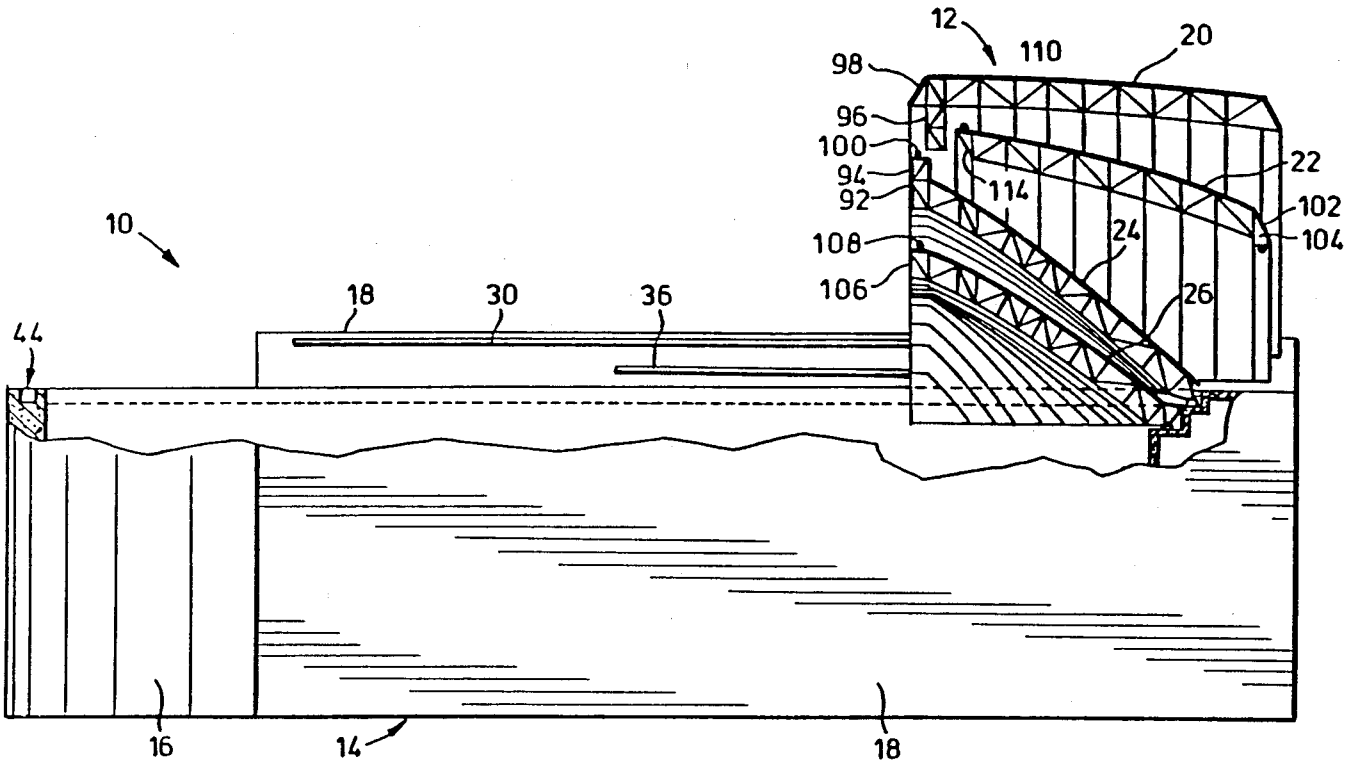
FIG. 13 is a diagrammatic side view of the stadium of FIG. 1 (in open position)

FIGS. 11 and 12 show the arrangement of trucks 28 associated with barrel vault 20. Not every truck 28 is needed to move vault 20 and the drive trucks are sequentially spaced between slave trucks 28*a* which are of the same construction as the drive trucks but do not carry motors 64.

Figure 7:
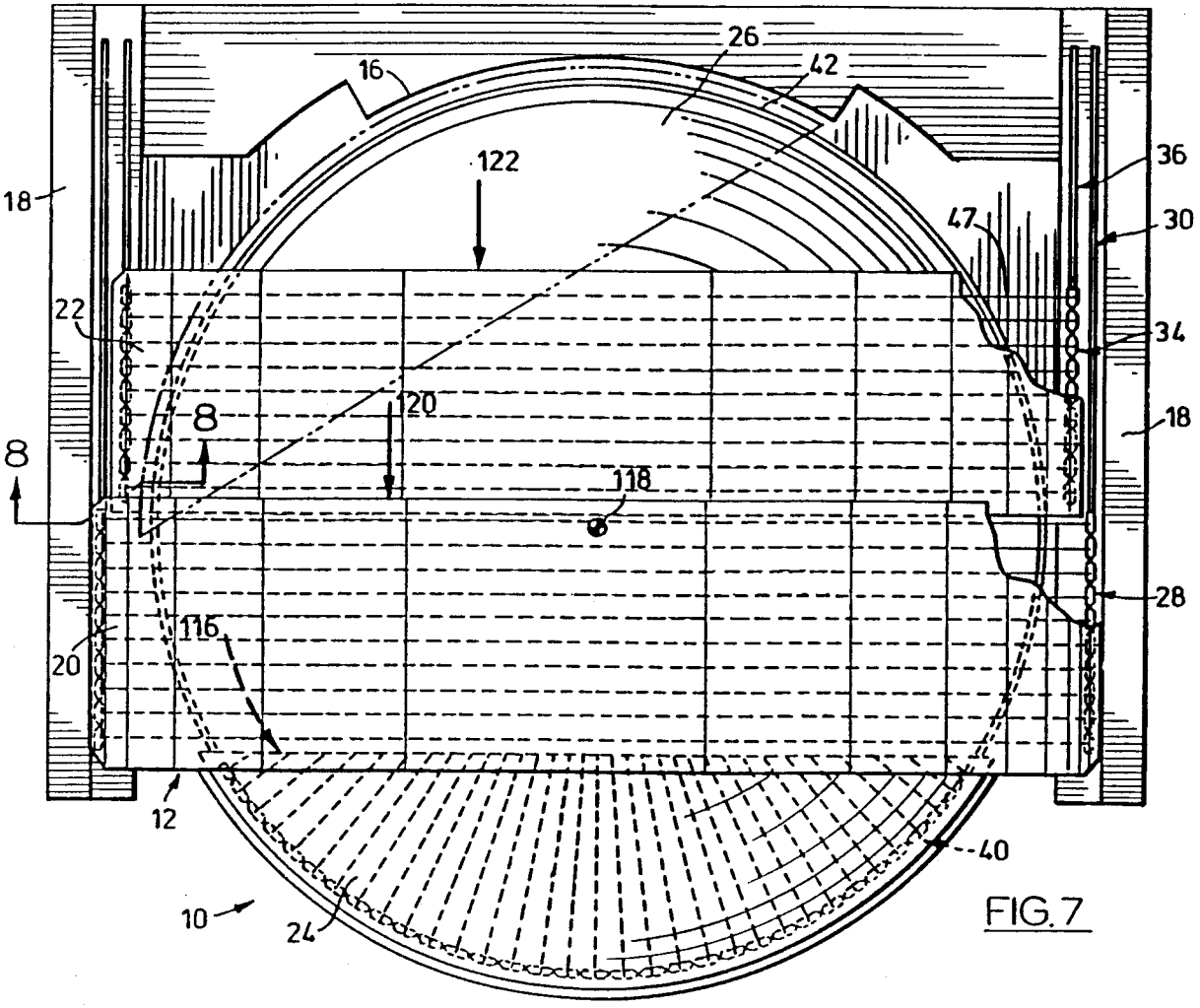
FIG. 7 a view similar to FIG. 6 showing diagrammatically the truck arrangement and closing movement of the movable end segment and the movable vaults.
Figure 8:
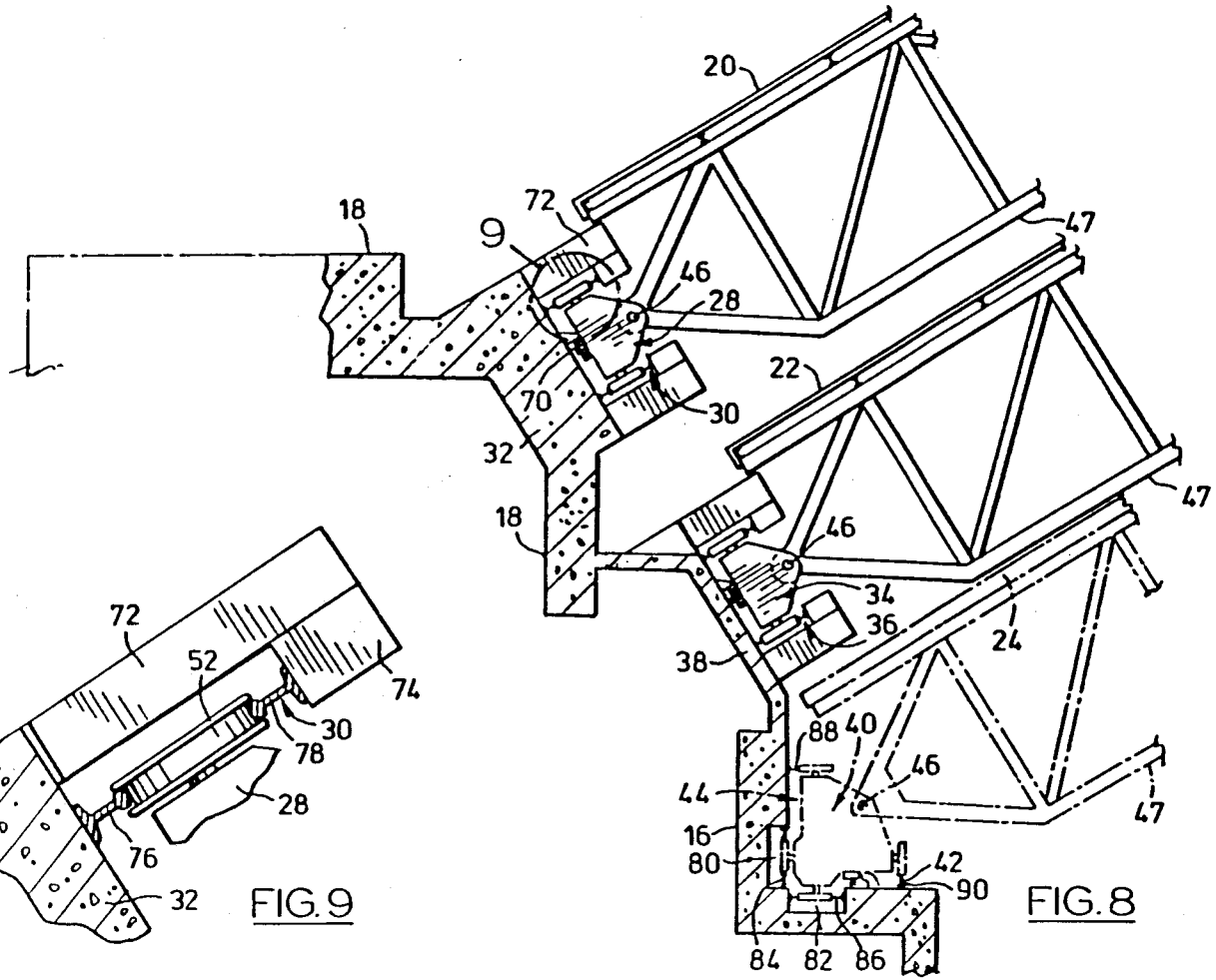
FIG. 8 is a cross-sectional view taken along line 8—8 of FIG. 7 showing the interrelationship between the side walls of the structure and the trucks of the movable end segment and the movable arches.
Figure 9:
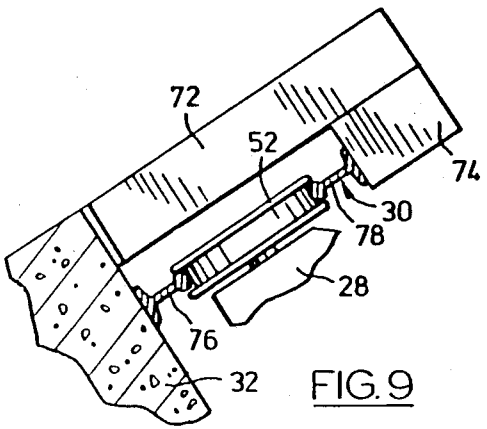
FIG. 9 is a fragmentary view of the area indicated by numeral 9 in FIG. 8.

As seen in FIGS. 1, 3, 5 and 13, dome 12 when open has end segment 24, vault 20, and vault 22 stacked above fixed end segment 26 in nesting position. To close dome 12 into the position shown in FIGS. 2, 4, 6 and 14, end segment 24 and vaults 20, 22 are moved as seen in FIG. 7. More particularly, end segment 24 is rotated on track 42 in the direction of arrow 116 about any imaginary centre of rotation 118, vault 20 is moved linearly on track 36 in the direction of arrow 120, and vault 22 is moved linearly on track 32 in the direction of arrow 122.

Figure 14:
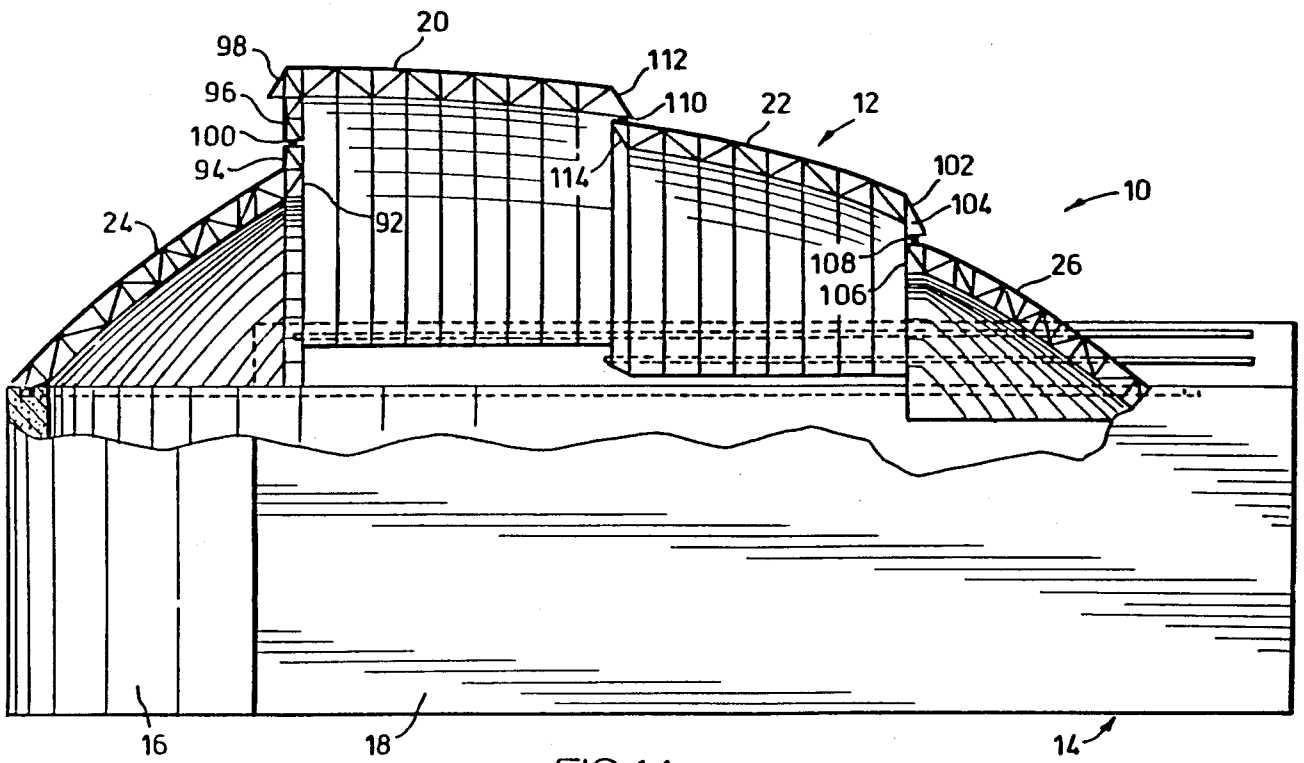
FIG. 14 is a diagrammatic side view of the stadium of FIG. 2 (in closed position)
Figure 15:
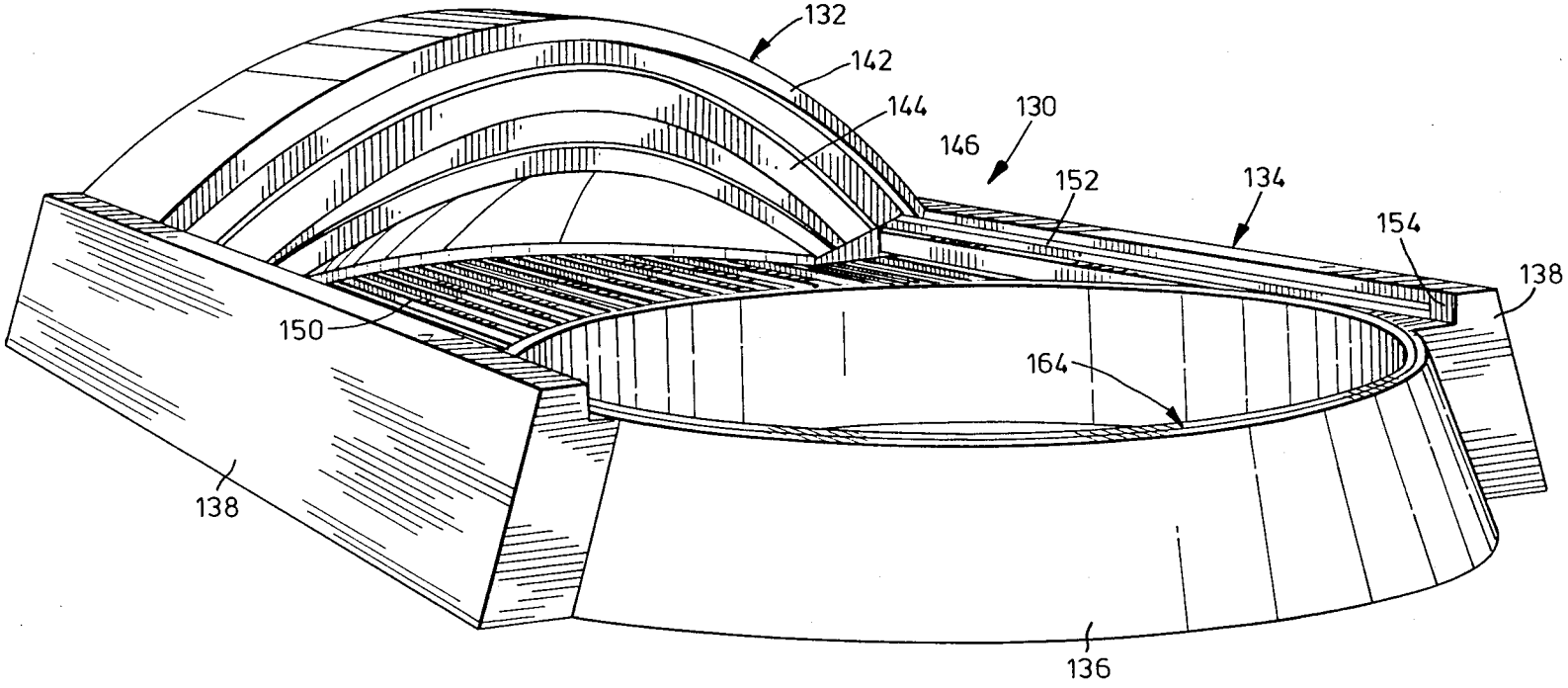
FIG. 15 is a perspective view of an alternate embodiment of a stadium having a roof retracted into an open position.
Figure 16:
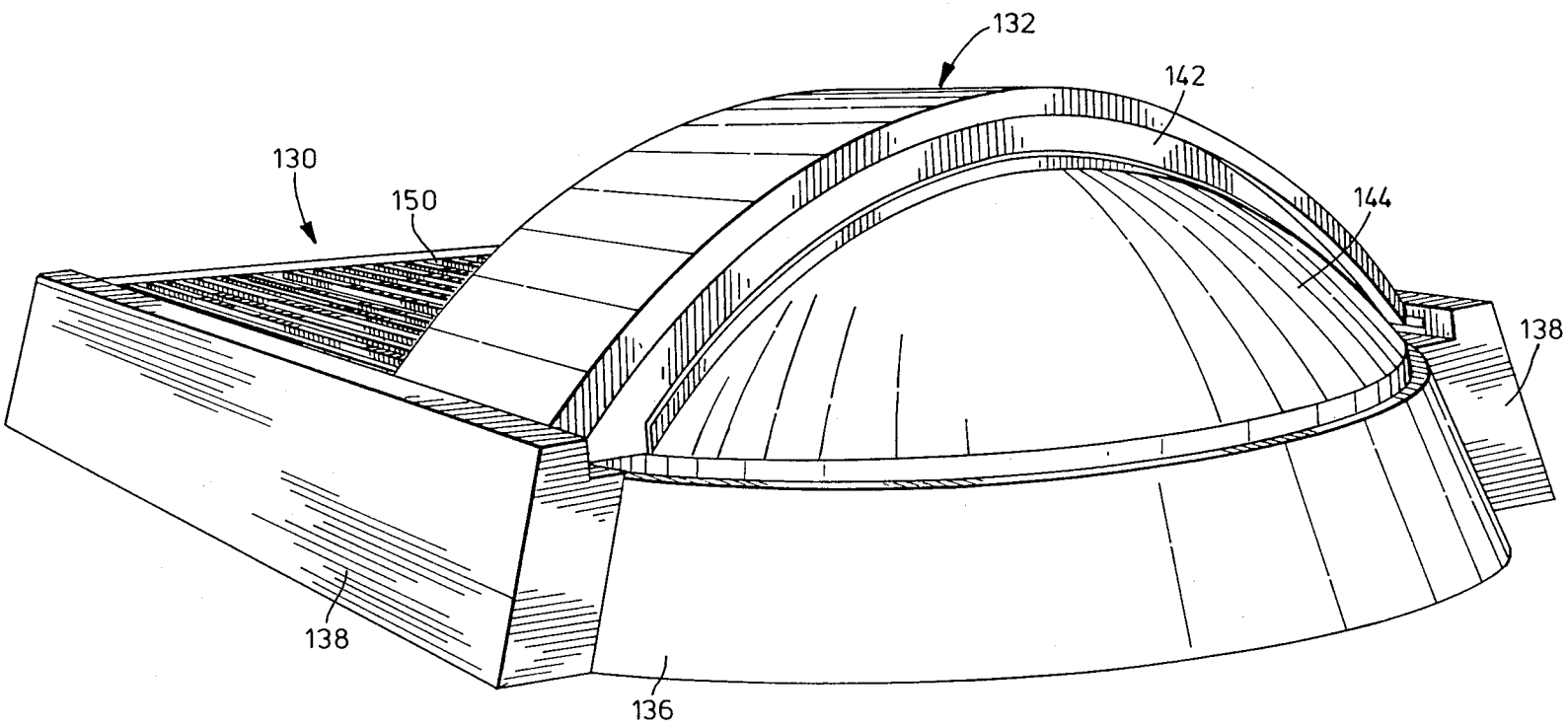
FIG. 16 a view of the stadium of FIG. 15 showing the roof in a losed position.
Figure 17:
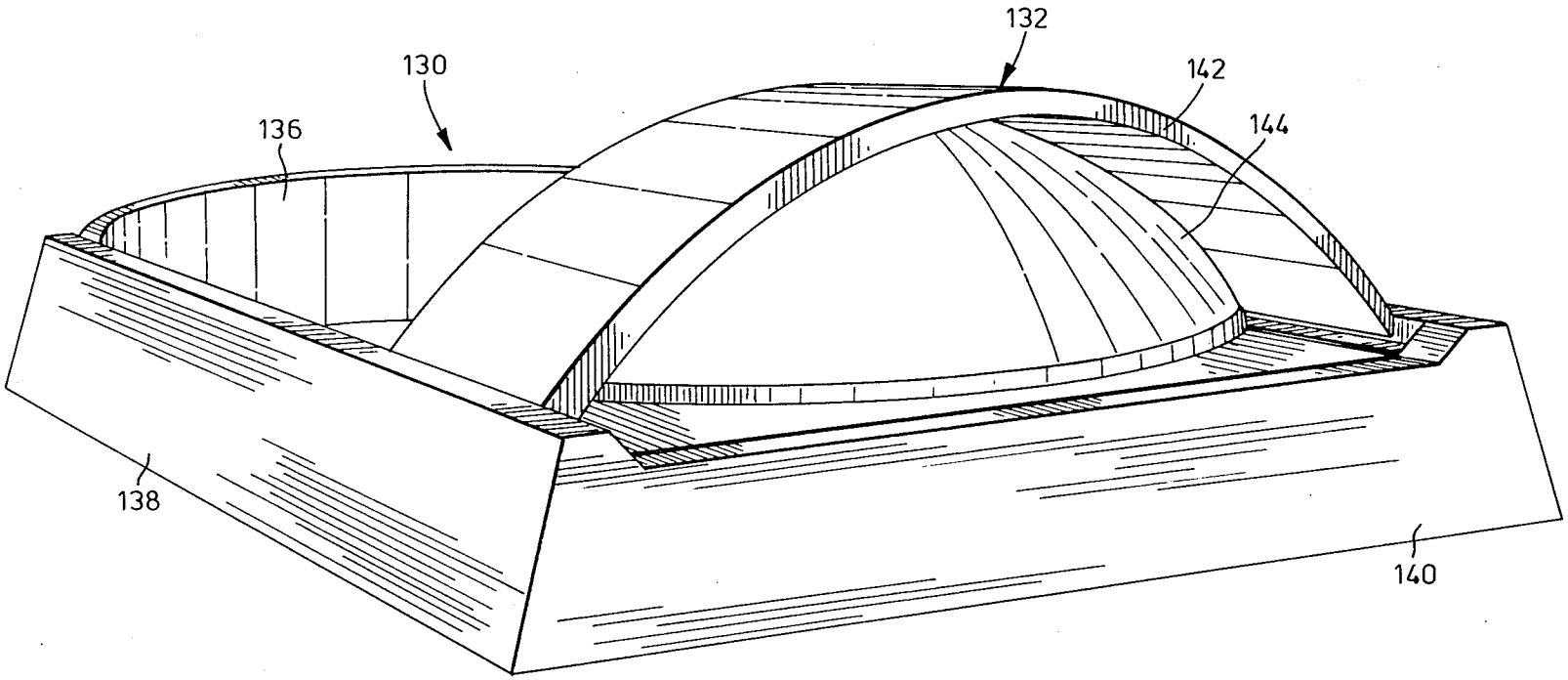
FIG. 17 is a perspective view of the stadium of FIG. 15 from the opposite end thereof.
Figure 18:
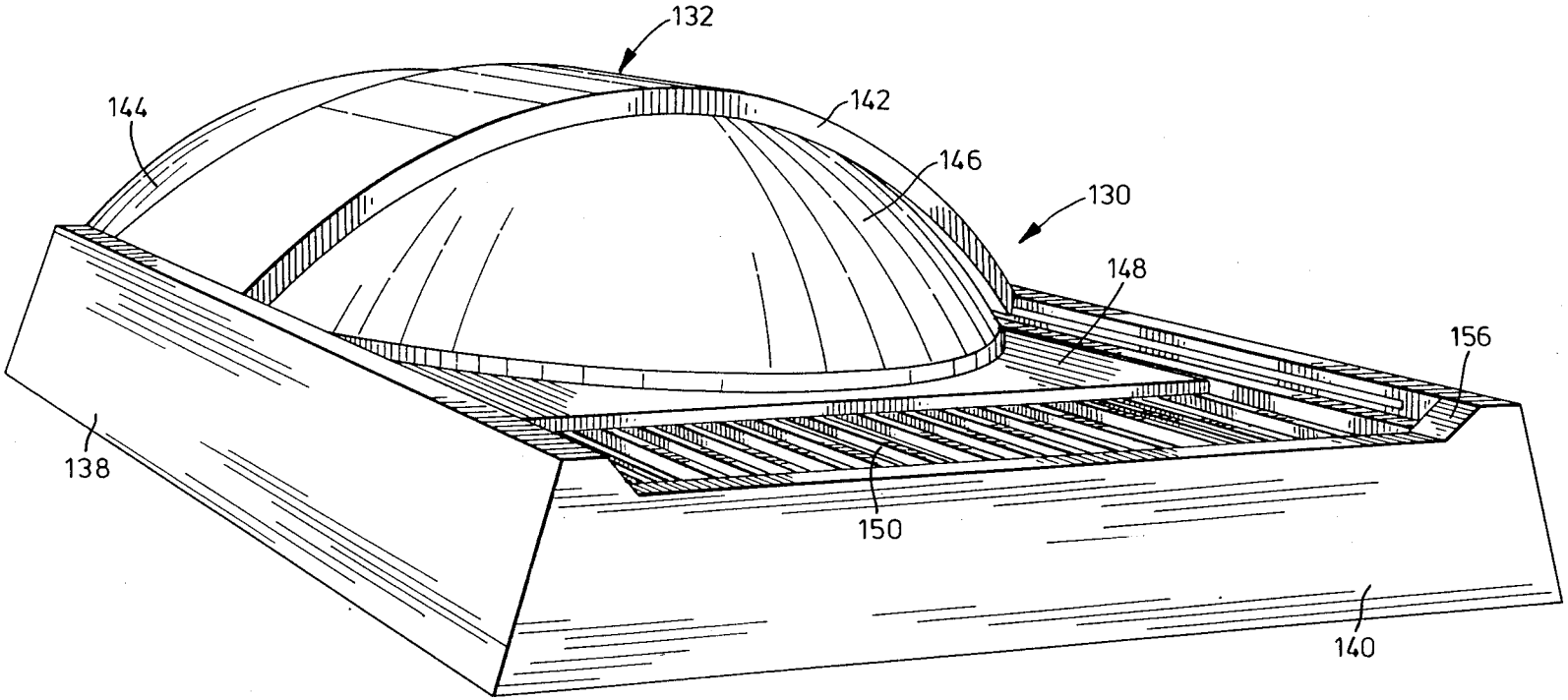
FIG. 18 is a perspective view of the stadium of FIG. 16 from the opposite end thereof.
Figure 19:
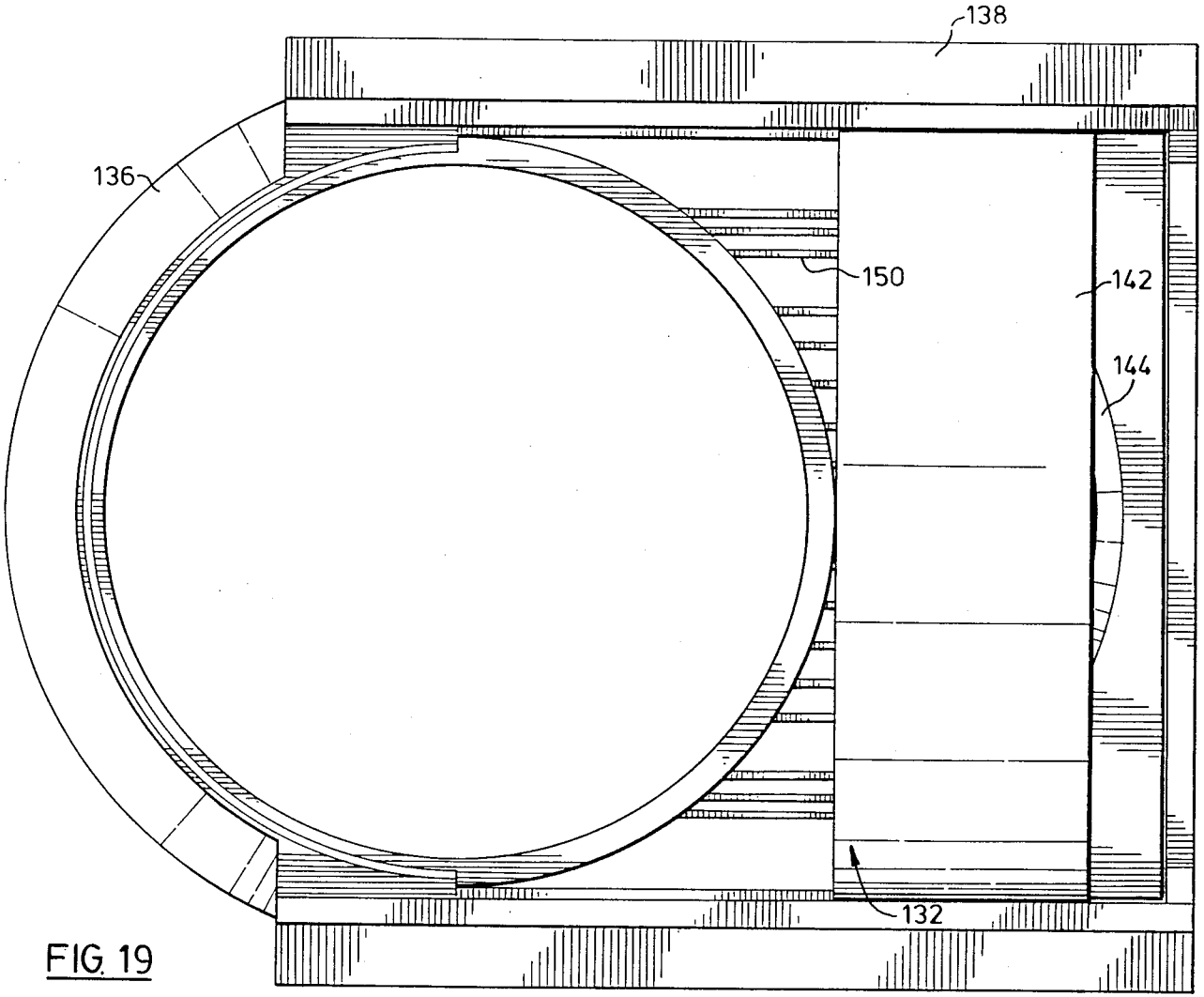
FIG. 19 plan view of the stadium of FIG. 15.
Figure 20:
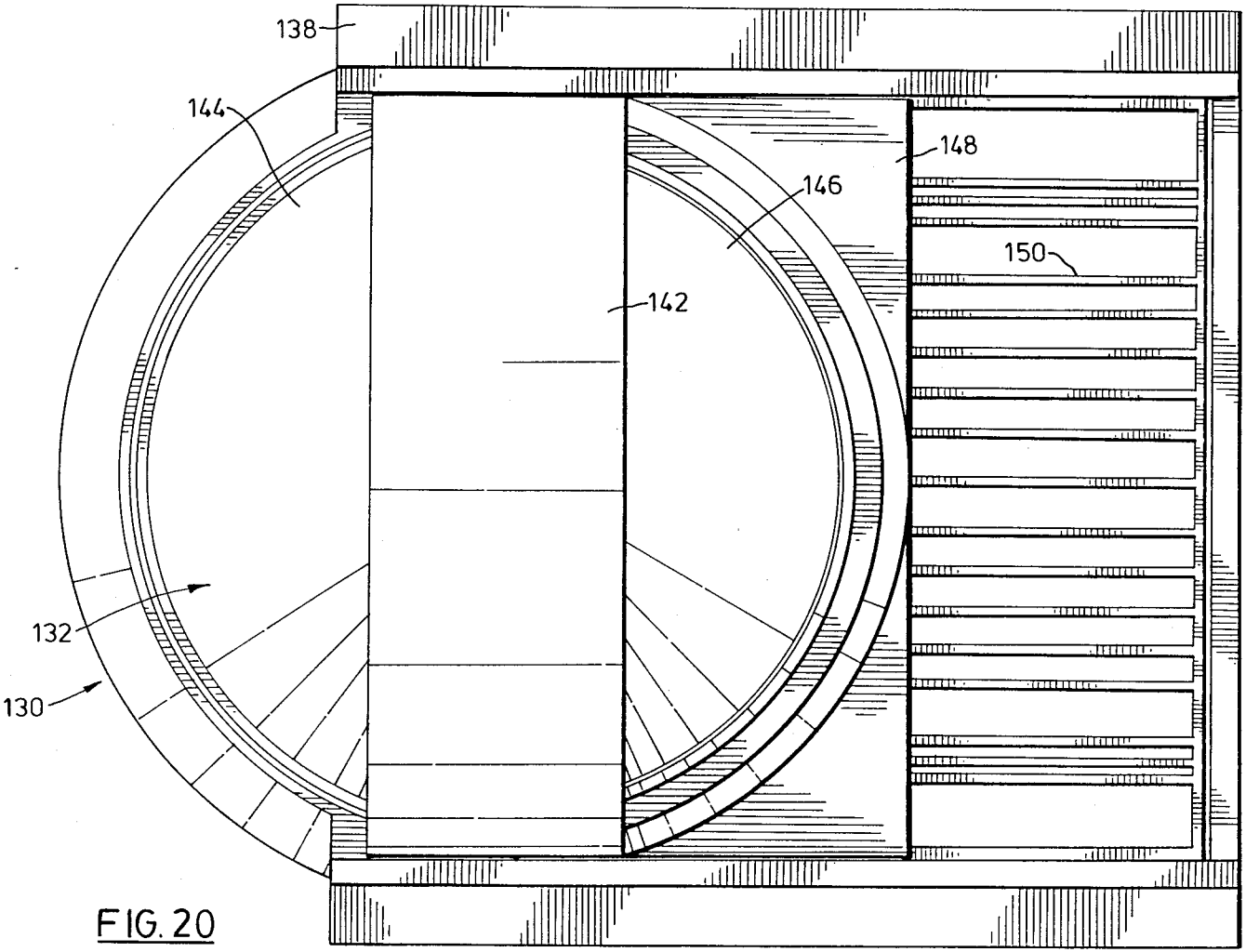
FIG. 20 is a plan view of the stadium of FIG. 16.
Figure 21:
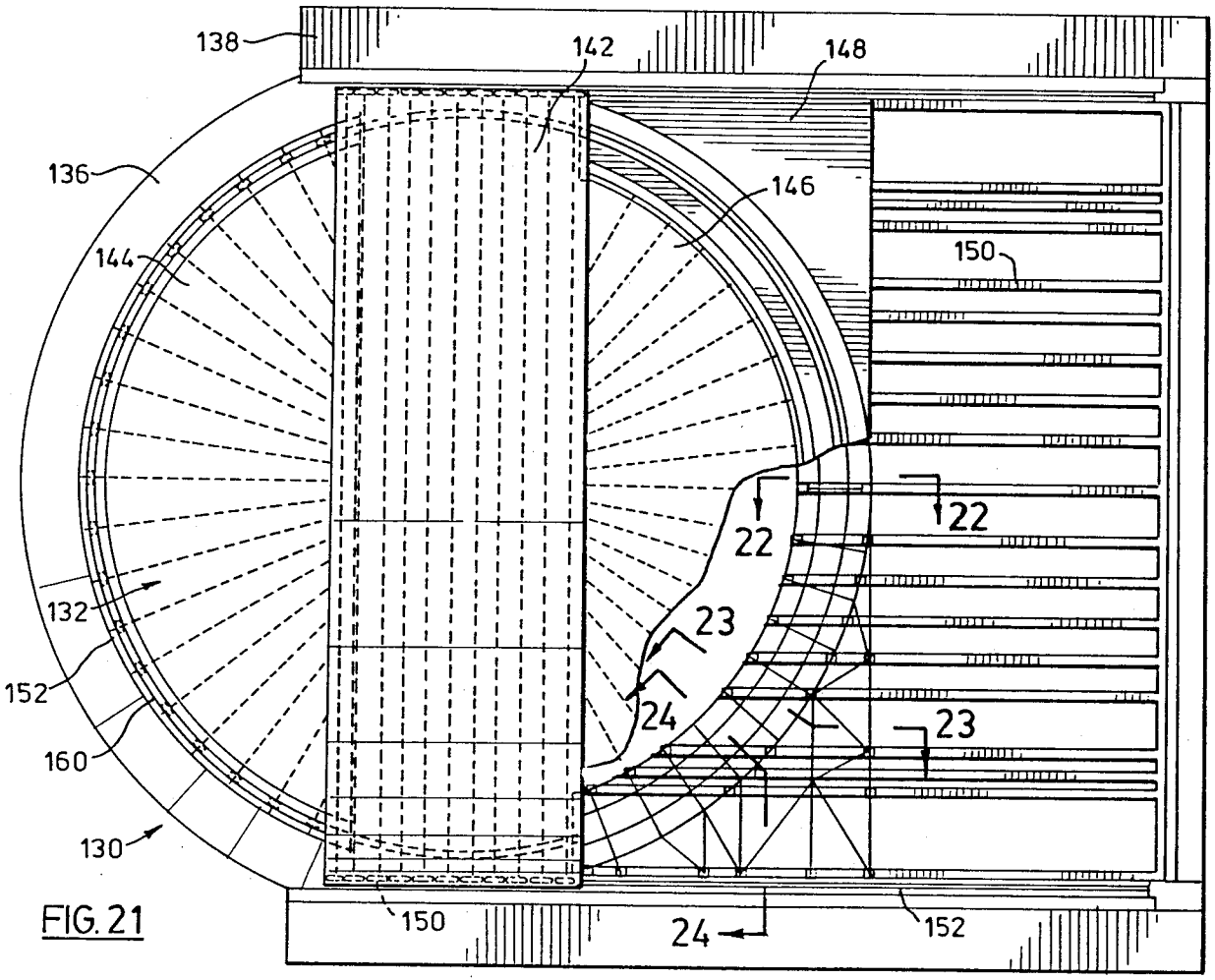
FIG. 21 is a view similar to FIG. 6 showing diagrammatically the truck arrangement of the end segments and the movable vault.
Figure 22:
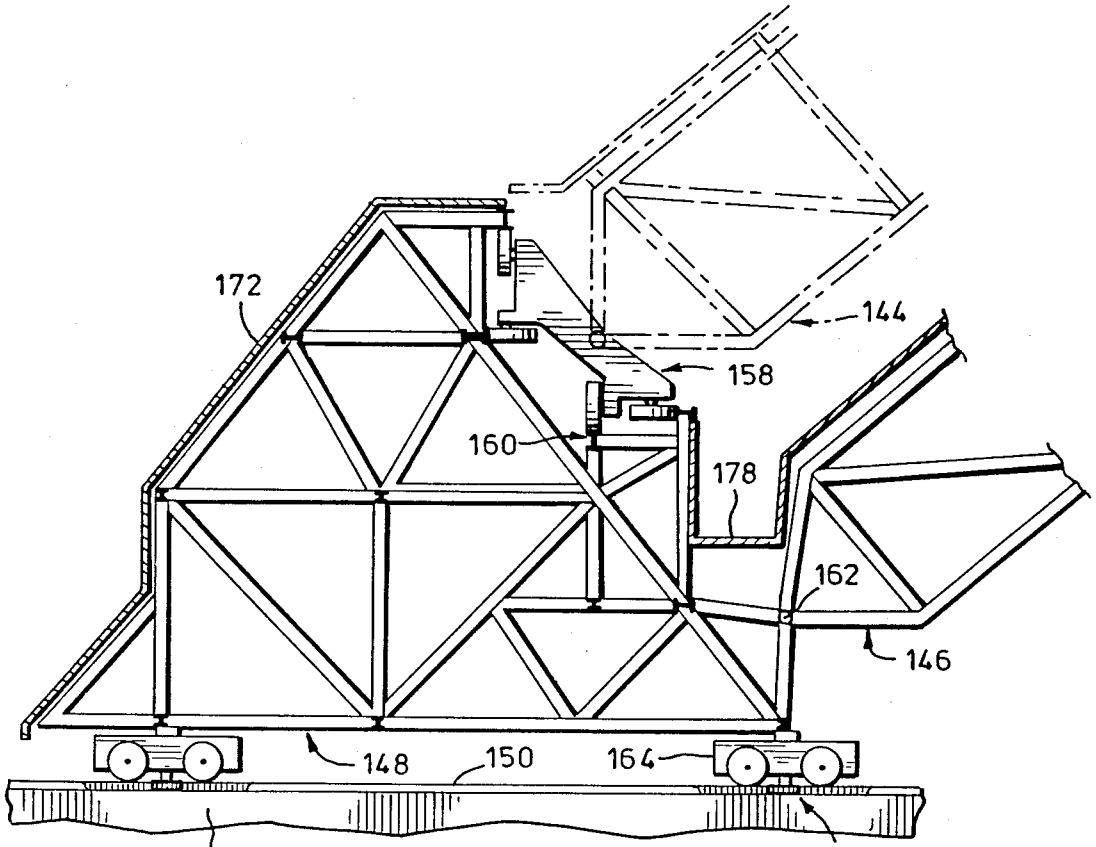
FIG. 22 is a cross-sectional view taken along line 22—22 of FIG. 21.
Figure 23:
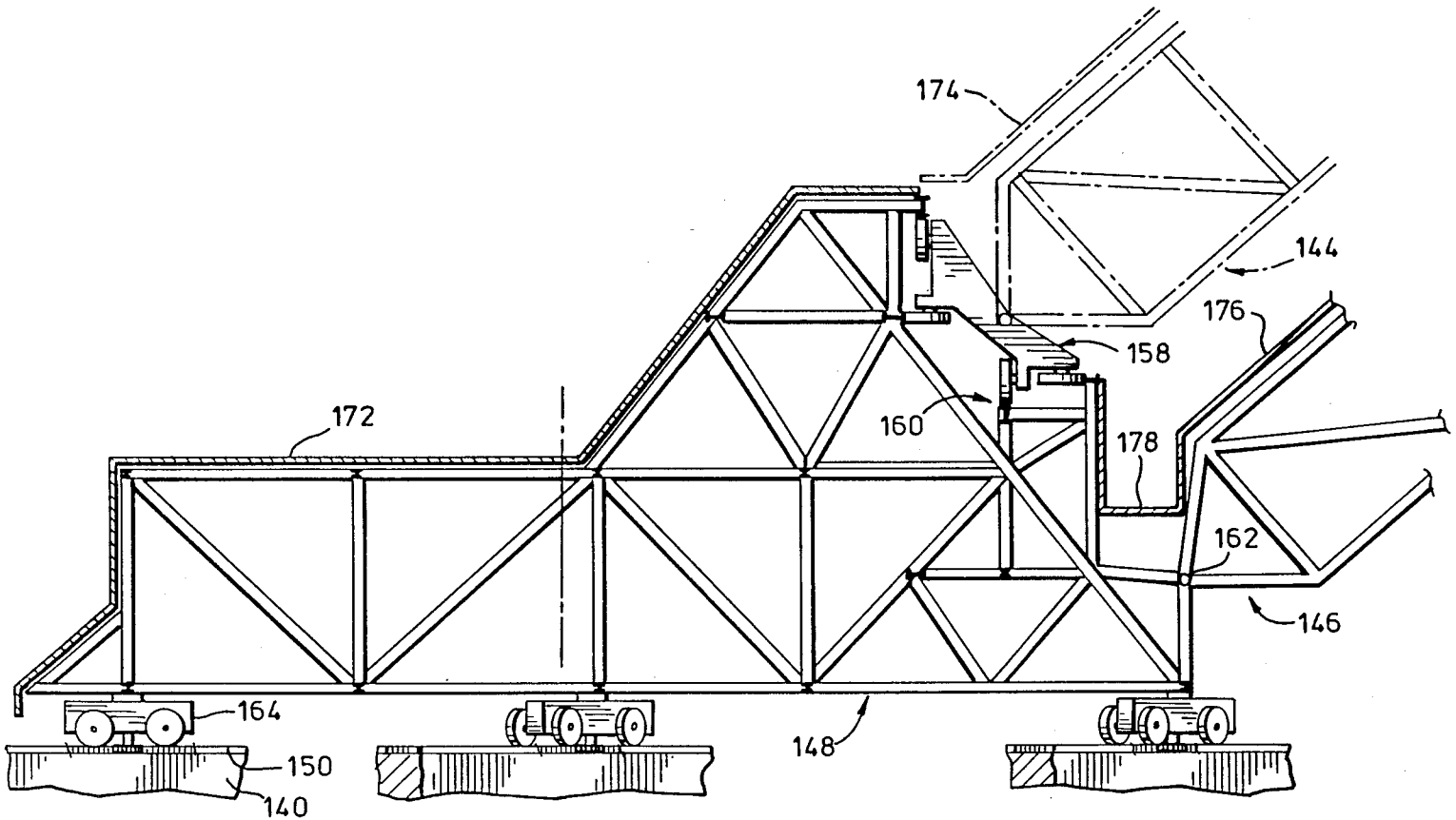
FIG. 23 is a cross-sectional view taken along line 23—23 of FIG. 22.

In the structure as seen in FIG. 14 it will be noted that vaults 20, 22 and end segments 24, 26 carry interengaging means to seal dome 12 in its closed position. In particular, end segment 24 carries at its upper edge 92 an upwardly extending flange 94 which cooperates with a downwardly extending flange 96 on leading edge 98 of vault 20 to form a vertical seal with a suitable sealing element 100. Similarly trailing edges 102 of vault 22 carries a downwardly extending flange 104 which cooperates with upper edge 106 of end segment 26 to close the gap between the vault and the segment together with a sealing element 108. A sealing element 110 between trailing edge 112 of vault 20 and leading edge 114 of vault 22 completes the sealing of dome 12.

The example embodiment shown in FIGS. 15 to 26 of the drawings consists of a stadium building 130 having a roof or dome 132 resting on a wall structure 134 comprising a circular wall 136, a pair of parallel opposed side walls 138 which are tangential to circular wall 136, and a platform 140 extending rearwardly of the circular wall between the side walls. Dome 132 consists of a central arch, comprising a barrel vault 142 which is preferably externally convex in lateral cross-section, and a pair of opposed ungular end segments 144 and 146. Barrel vault 142 is mounted movably on side walls 138, end segment 144 is mounted movably on circular wall 136, and end segment 146 is mounted on a carriage 148 which is movable on a plurality of parallel rails 150 resting on platform 140.

Figure 24:
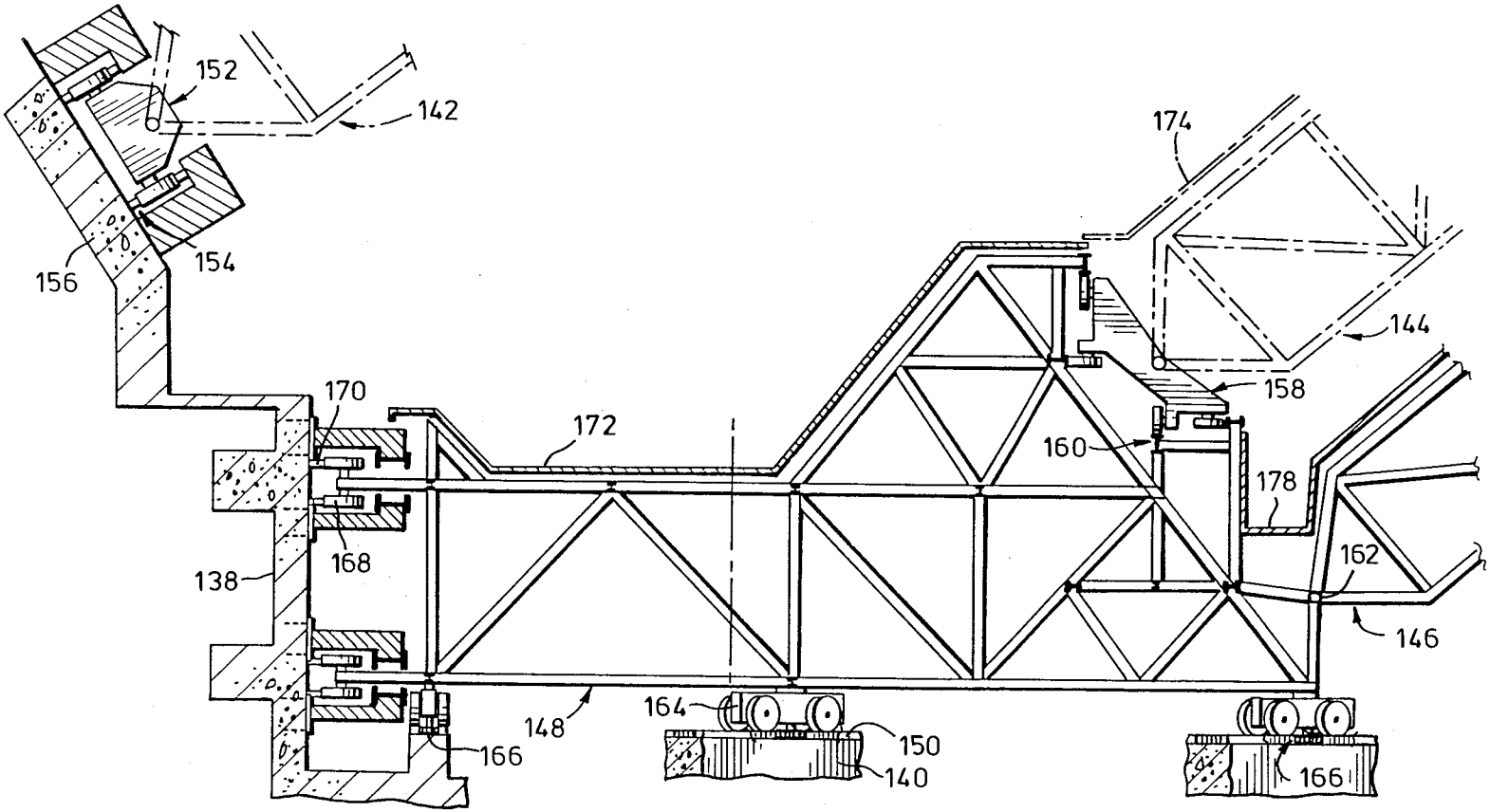
FIG. 24 is a cross-sectional perspective view taken along line 24—24 of FIG. 22.

The manner of mounting barrel vault 142, end segment 144 and carriage 148 is shown in FIG. 24. Each end of barrel vault 142 is carried on a row of trucks 152 which travel on a set of tracks 154 fixed on opposed shoulders 156 on side walls 138, each truck being pin connected to the end of a truss of barrel vault 142. End segment 144 is carried on a row of trucks 158 which travel on sets of tracks 160 fixed on carriage 148, each truck being pin connected to the end of a truss of the end segment. The ends of the trusses of end segment 146 are connected by pins 162 to carriage 148 which is carried on rows of trucks 164 travelling on rails 150. Each truck 158 is is independently driven by motor means (not shown) while each truck 164 is driven by a rack and pinion combination 166 in the same manner as trucks 28 in the previous embodiment. Carriage 148 includes additional trucks 168 which bear laterally against subsidiary rails 170 fixed on side walls 138 of building 130. A sheet cover 172 is mounted on carriage 148 and meets with a cover 174 on segment 144, segment 146 also having a cover 176 which includes a gutter 178.

Figure 26:
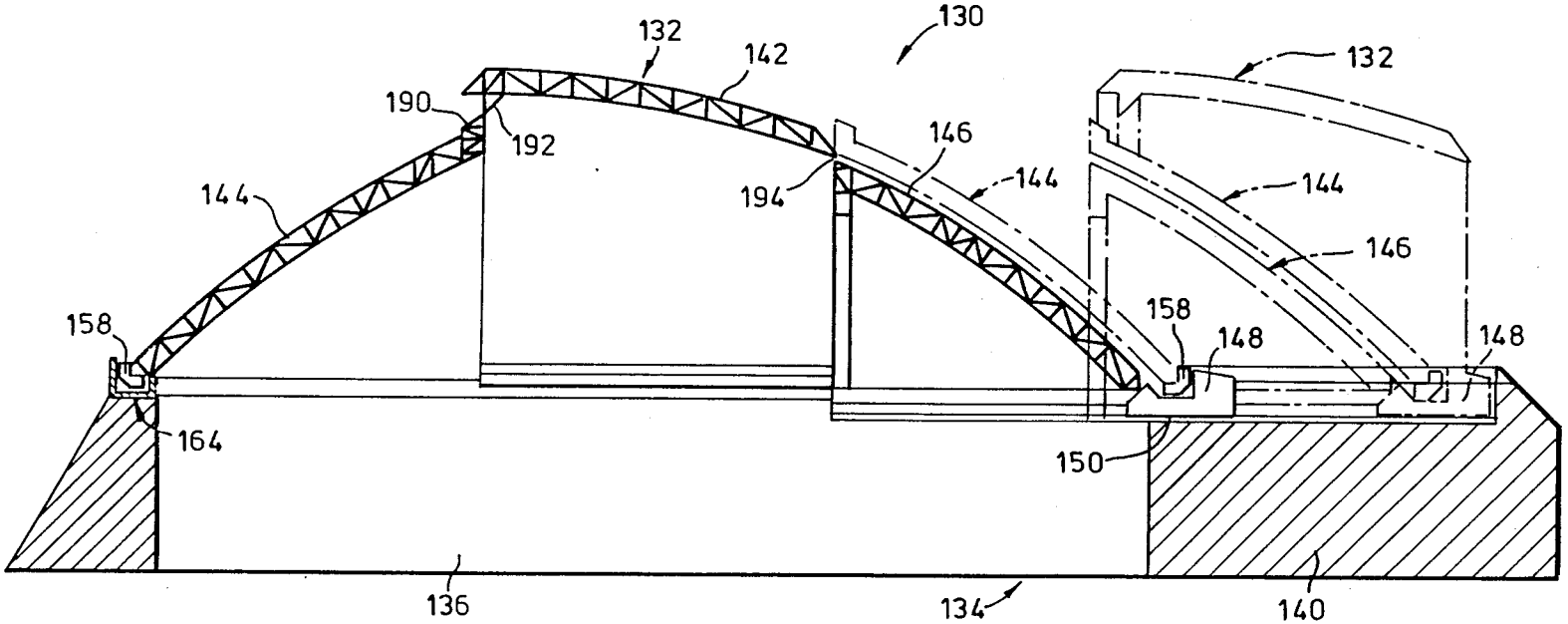
FIG. 26 is a diagrammatic side view of the stadium of FIG. 16 (in closed position).

The manner of opening and closing dome 132 is shown in FIGS. 25 and 26 of the drawings. From a closed position of dome 132 as seen in FIG. 25*a* and 26, end segment 144 is rotated on trucks 158 in the direction of arrow 180 as seen in FIGS. 25*b*, 25*c* and 25*d* until it comes to rest in a nesting position above segment 146 as seen in FIGS. 25*e* and FIG. 26. At the same time barrel vault 142 is moved rearwardly on trucks 152 in the direction of arrow 182 as seen in FIGS. 25*b*, 25*c* and 25*d* until it comes to rest as seen in FIG. 25*e* and FIG. 26. Next nesting segments 144 and 146 are moved rearwardly by carriage 148 on trucks 164 in the direction of arrow 184 as seen in FIGS. 25*f* and 25*g* until they rest beneath barrel vault 142 as seen in FIG. 25*h* and FIG. 26, completely exposing the interior of stadium 130 within circular wall 136.

Carriage 148 is constructed with trusses to distribute the loads of end segments 144 and 146, a portion of the loads being transferred to side walls 138 by lateral trucks 168. As in the previous embodiment, seals are provided between barrel vault 142 and end segments 144, 146 when dome 12 is in a closed position. Trucks 164 of carriage 148 are driven by rack and pinion to control uniform movement of the truck array.

As in the previous embodiment, barrel vault 142 and end segments 144 and 146 carry interengaging means to seal dome 132 in its closed position. In particular, end segment 144 carries at its upper edge an upwardly extending flange 190 which cooperates with a downwardly extending flange 192 on the leading edge of vault 142 to form a seal and the trailing edge of the vault carries a seal 194 which interengages with end segment 146.

We claim:

1. In a stadium building, a retractable roof comprising a central arch separating a pair of ungular end segments, one end segment being movable into nesting relationship with the other end segment, and the central arch being movable to rest above the nesting end segments, the nesting end segments and the above nesting central arch being movable laterally whereby the interior of the stadium is more fully exposed.

2. A stadium building as claimed in claim 1 including an assembly of parallel rails having the arch movably mounted thereon, an arcuate rail assembly having said one end segment movably mounted thereon, and a further assembly of parallel rails having a carriage movably mounted thereon, said other end segment being mounted on the carriage and said one end segment being movable onto the carriage for nesting, the nesting end segments being movable laterally on said further rail assembly.

3. A stadium building as claimed in claim 2 in which the rail assemblies include means to carry an uplift load.

4. A stadium building as claimed in claim 1 in which the central arch is externally convex in lateral cross-section.

5. A stadium building as claimed in claim 1 in which the stadium building comprises a circular wall, a pair or opposed parallel side walls tangential to the circular wall, and a platform extending rearwardly from the circular wall between the side walls, an assembly of parallel rails fixed along the side walls and having the arch movably mounted thereon, an arcuate rail assembly fixed along the circular wall and having said one end segment movably mounted thereon, and a further assembly of parallel rails fixed on the platform and having a carriage movably mounted thereon, said other end segment being mounted on the carriage and said one end segment being movable onto the carriage for nesting, the nesting end segments being movable laterally on said further rail assembly.

6. A stadium building as claimed in claim 5 in which the central arch carries a plurality of trucks at each end thereof engaging the parallel rail assembly, each truck having a plurality of flanged wheels journally mounted thereon, the rail assembly comprising a plurality of rails engaging the wheels whereby both upward wind loads and downward weight loads are accommodated, and drive means mounted on at least one of the trucks.

7. A stadium as claimed in claim 5 in which said one end segment carries a plurality of trucks engaging the arcuate rail assembly, each truck having a plurality of flanged wheels journally mounted thereon, the rail assembly comprising a plurality of rails engaging the wheels whereby both upward wind loads and downward weight loads are accommodated, and drive means mounted on at least one of the trucks.

8. A stadium as claimed in claim 5 in which the carriage carries a plurality of trucks engaging the further assembly of parallel rails, each truck having a plurality of flanged wheels journally mounted thereon, and drive means mounted on a plurality of the trucks.

9. A stadium as claimed in claim 8 in which said drive means comprises a drive motor and a pinion driven thereby, a rack mounted on the platform and engaged by the pinion.

10. A stadium as claimed in claim 8 including an assembly of subsidiary parallel rails fixed along the side walls, the carriage carrying a further plurality of laterally disposed trucks engaging the subsidiary rails whereby a portion of the load is transmitted from the end segments through the carried to the side walls.

* * * * *